US008998055B2

(12) United States Patent
Henson et al.

(10) Patent No.: US 8,998,055 B2
(45) Date of Patent: Apr. 7, 2015

(54) TOWEL DISPENSER WITH AUTO-LOAD ARRANGEMENT

(75) Inventors: Mark W. Henson, Danville, KY (US); Adam T. Elliott, Lexington, KY (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 901 days.

(21) Appl. No.: 12/930,153

(22) Filed: Dec. 28, 2010

(65) Prior Publication Data

US 2012/0165974 A1 Jun. 28, 2012

(51) Int. Cl.
*B65H 20/00* (2006.01)
*A47K 10/36* (2006.01)

(52) U.S. Cl.
CPC ..... *A47K 10/36* (2013.01)

(58) Field of Classification Search
USPC ..... 226/8, 12, 88, 91, 92, 100, 134, 152; 242/562.1, 563, 564.1, 564.4, 558, 242/560.1; 83/203, 648–650; 225/10–16, 225/23, 32, 54; 312/34.4; 221/43, 42, 61, 221/62, 70, 71
See application file for complete search history.

(56) References Cited

U.S. PATENT DOCUMENTS

| | | | | | |
|---|---|---|---|---|---|
| 2,117,396 | A * | 5/1938 | Birr | 221/38 |
| 2,118,627 | A * | 5/1938 | Steiner | 226/131 |
| 2,337,065 | A * | 12/1943 | Price | 221/15 |
| 2,772,021 | A * | 11/1956 | Kettles | 221/38 |
| 2,850,345 | A * | 9/1958 | Marcuse | 225/23 |
| 2,974,839 | A * | 3/1961 | Batlas | 225/12 |
| 3,288,387 | A * | 11/1966 | Craven, Jr. | 242/560.1 |
| 4,165,138 | A * | 8/1979 | Hedge et al. | 242/560 |
| 4,807,824 | A * | 2/1989 | Gains et al. | 242/560.1 |
| 5,131,302 | A | 7/1992 | Watanabe | |
| 2003/0132261 | A1 * | 7/2003 | Formon et al. | 225/2 |
| 2005/0051005 | A1 * | 3/2005 | Broehl | 83/13 |

FOREIGN PATENT DOCUMENTS

| | | | |
|---|---|---|---|
| EP | 0 099 602 | A1 | 2/1984 |
| WO | WO 2006/071148 | A1 | 7/2006 |

OTHER PUBLICATIONS

International Search Report and Written Opinion mailed May 10, 2012.

* cited by examiner

*Primary Examiner* — William E Dondero
(74) *Attorney, Agent, or Firm* — Merchant & Gould P.C.

(57) ABSTRACT

A dispenser for dispensing paper toweling. The dispenser including a towel support that is positionable in a first dispensing position when a drive roller rotates in a first direction, and that is positionable in a second auto-loading position when the drive roller rotates in a second direction. Rotation of the drive roller in the first and second directions automatically loading the paper toweling for subsequent dispense.

16 Claims, 17 Drawing Sheets

TOWEL DISPENSER WITH AUTO-LOAD ARRANGEMENT

FIELD OF THE TECHNOLOGY

The present disclosure relates generally to towel dispensing devices, and various methods associated with such devices. More particularly, this disclosure relates to paper towel dispensers that dispenses a length of towel from a continuous length of toweling, and various methods associated with such paper towel dispensers.

BACKGROUND

A variety of paper towel dispensing arrangements currently exist. One common arrangement includes a paper towel dispenser having two rollers that rotate to dispense a length of paper towel. When loading or filling such a dispenser with toweling, a leading end of the toweling is manually inserted between the two rollers. The rollers are then turned to position the end where needed. These types of dispensers typically require maintenance each time the dispenser is replenished with new units of paper toweling. That is, a maintenance person is required to manually insert the leading end of each new replenishing unit of paper toweling when the leading unit of toweling is depleted. As can be understood, a dispenser can therefore sit inoperable for some time before a maintenance person is available to re-load the dispenser for use.

In addition and with some dispensers, it is difficult to physically fit one's hands within the dispenser interior to manually insert the end of a unit of paper toweling between the two rollers, as dispensers are often designed to minimize spatial requirements.

Improvements to paper towel dispensers, generally to allow for ease of maintenance and reliability of use, is needed.

SUMMARY

One aspect of the present disclosure relates to a dispenser for dispensing a towel from a continuous length of paper toweling. The dispenser includes a dispenser housing defining a paper supply region. To load the dispenser, paper toweling is placed within the supply region. The dispenser automatically loads a leading end of the paper toweling for subsequent dispense. The automatic loading operation of the dispenser is generally accomplished by moving a towel support from a first dispensing position to a second auto-loading position in collaboration with predetermined rotational movement of a drive roller.

A variety of examples of desirable product features or methods are set forth in part in the description that follows, and in part will be apparent from the description, or may be learned by practicing various aspects of the disclosure. The aspects of the disclosure may relate to individual features as well as combinations of features, including combinations of features disclosed in separate embodiments. It is to be understood that both the foregoing general description and the following detailed description are explanatory only, and are not restrictive of the claimed invention.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
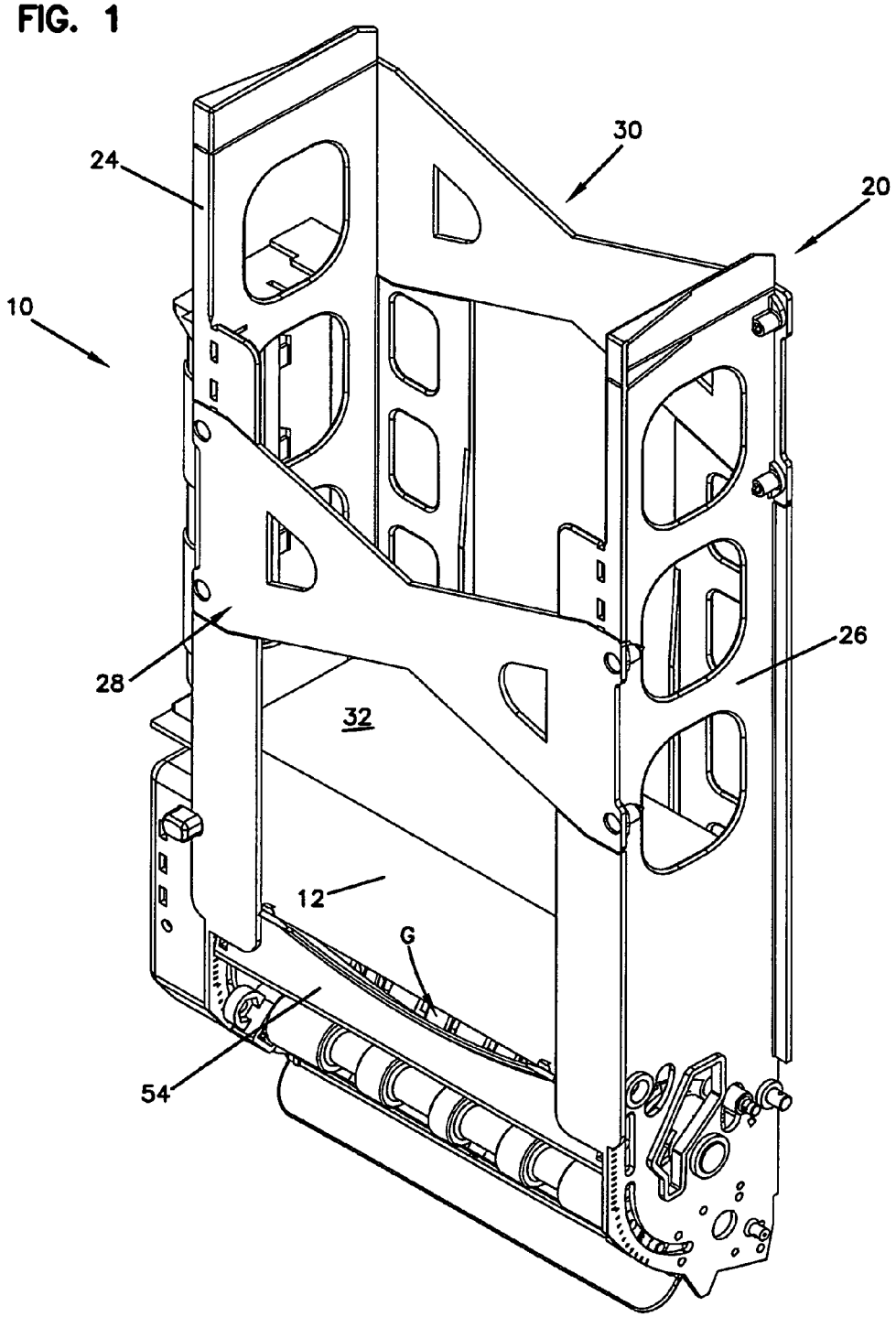
FIG. 1 is a front perspective view of a paper towel dispenser, shown without a cover, in accordance with the principles disclosed.
Figure 2:
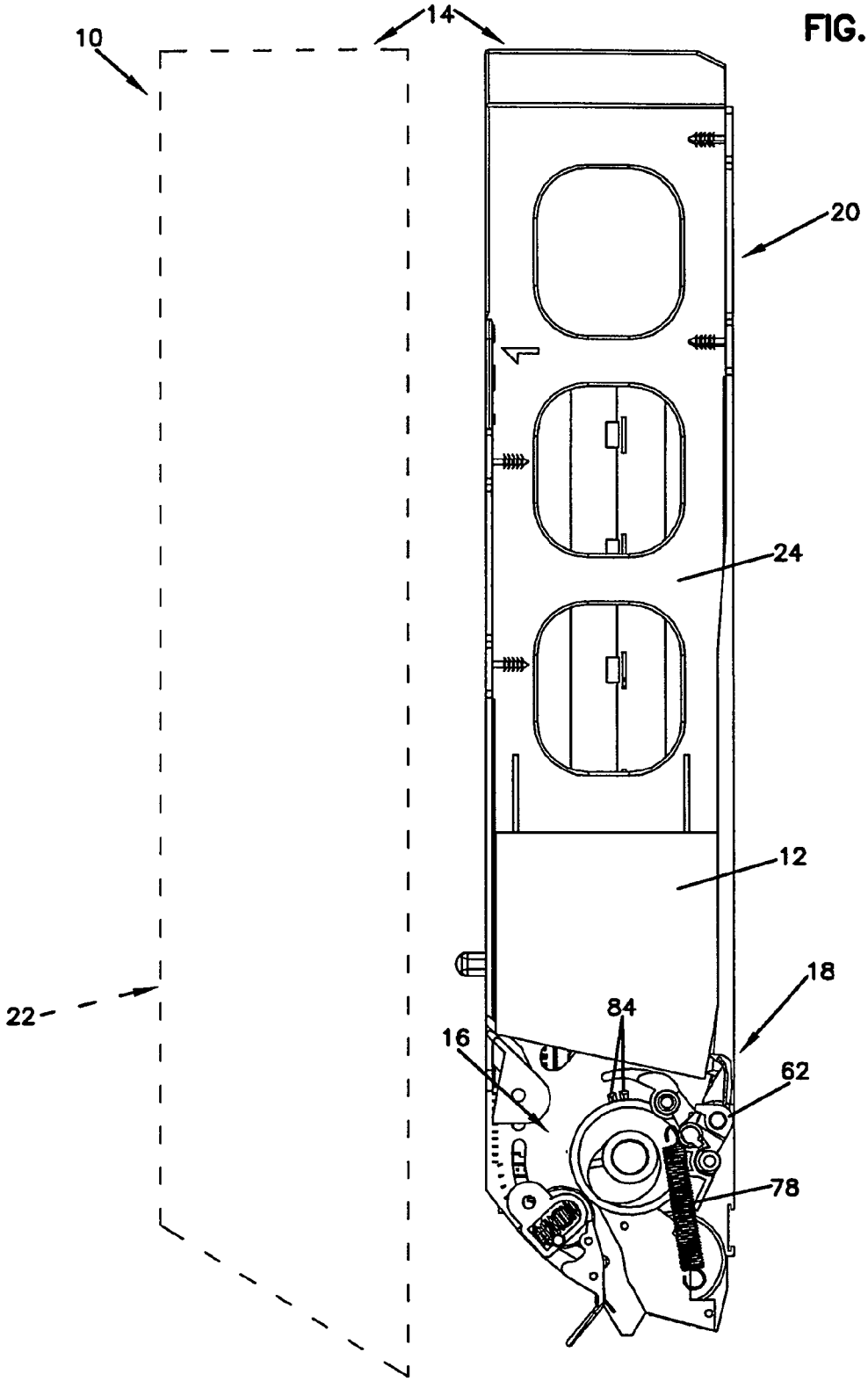
FIG. 2 is a side elevation view of the paper towel dispenser of FIG. 1, illustrated with a schematic cover representation and without a side portion of a frame.

Referring to FIGS. 1 and 2, the present disclosure relates to a paper towel dispenser 10. In one embodiment, the paper towel dispenser 10 dispenses predetermined lengths of paper towels from a continuous length of paper toweling 12. While in much of the present description reference is made to a paper towel dispenser, it is to be understood that the principles disclosed are not limited to only paper-product dispensers, but can be applied to other types of towel dispenser as well.

In general, the present towel dispenser 10 includes a dispenser housing 14, a drive mechanism 16 that dispenses the lengths of paper towels, and an automatic paper-loading arrangement 18.

The dispenser housing 14 of towel dispenser 10 includes a frame 20 and a removable cover 22. The frame 20 generally includes upright sides 24, 26 and front and rear frame portions 28, 30 that define a paper supply region 32.

The paper supply region 32 (FIG. 1) is sized to receive the continuous length of paper toweling 12. What is meant by "continuous length" is that the paper toweling is in the form of a paper web, as opposed to individual pre-cut sheets of paper towels. In the illustrated embodiment, the continuous length of paper toweling is a continuous length of pleated paper toweling. What is meant by "pleated" is that the continuous length includes a plurality of alternating fold lines. In an alternative embodiment, the continuous length of paper toweling can be a continuous length of rolled paper toweling.

Typically the continuous length of paper toweling is non-perforated (i.e., the web has no spaced separation lines).

Figure 3:
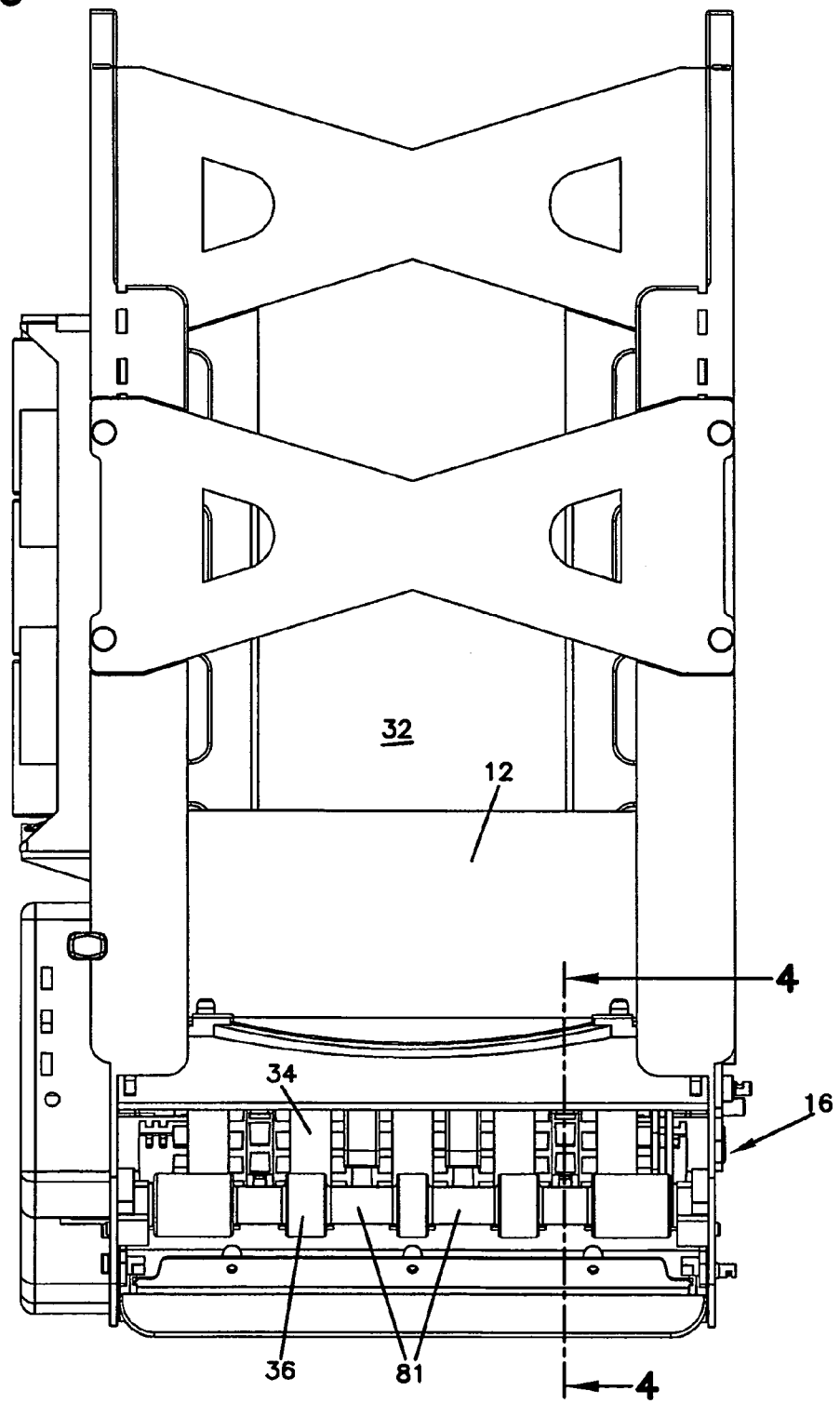
FIG. 3 is a front elevation view of the paper towel dispenser of FIG. 1.
Figure 4:
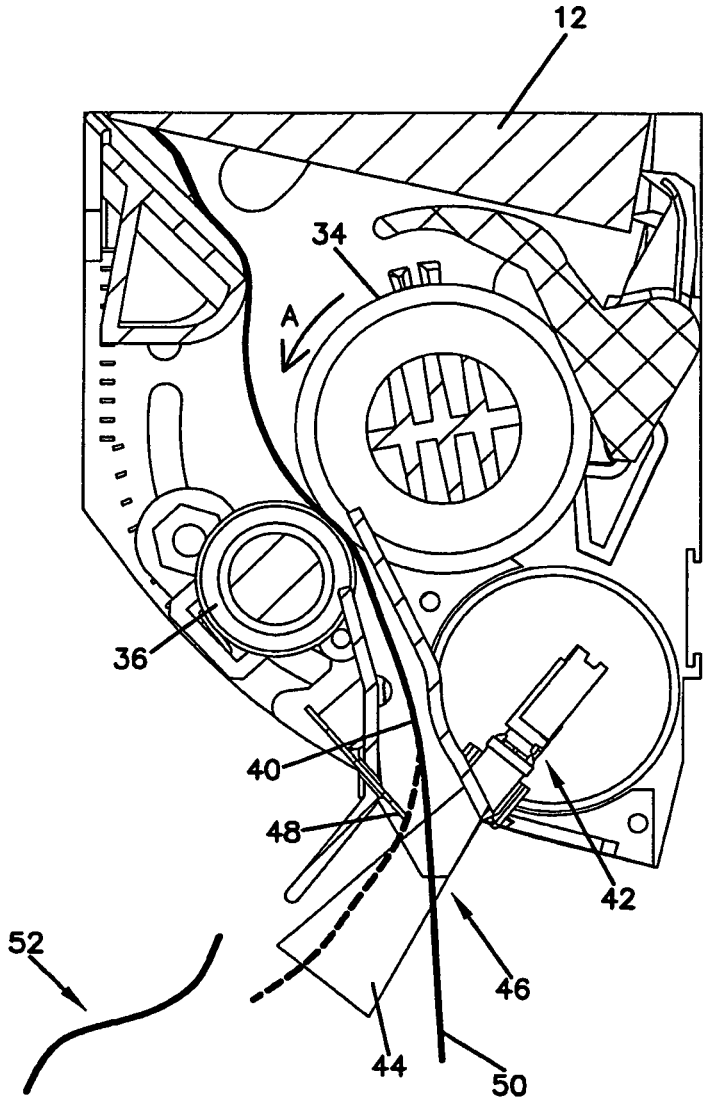
FIG. 4 is a cross-sectional view of a portion of the paper towel dispenser of FIG. 3, taken along line 4-4.
Figure 5:
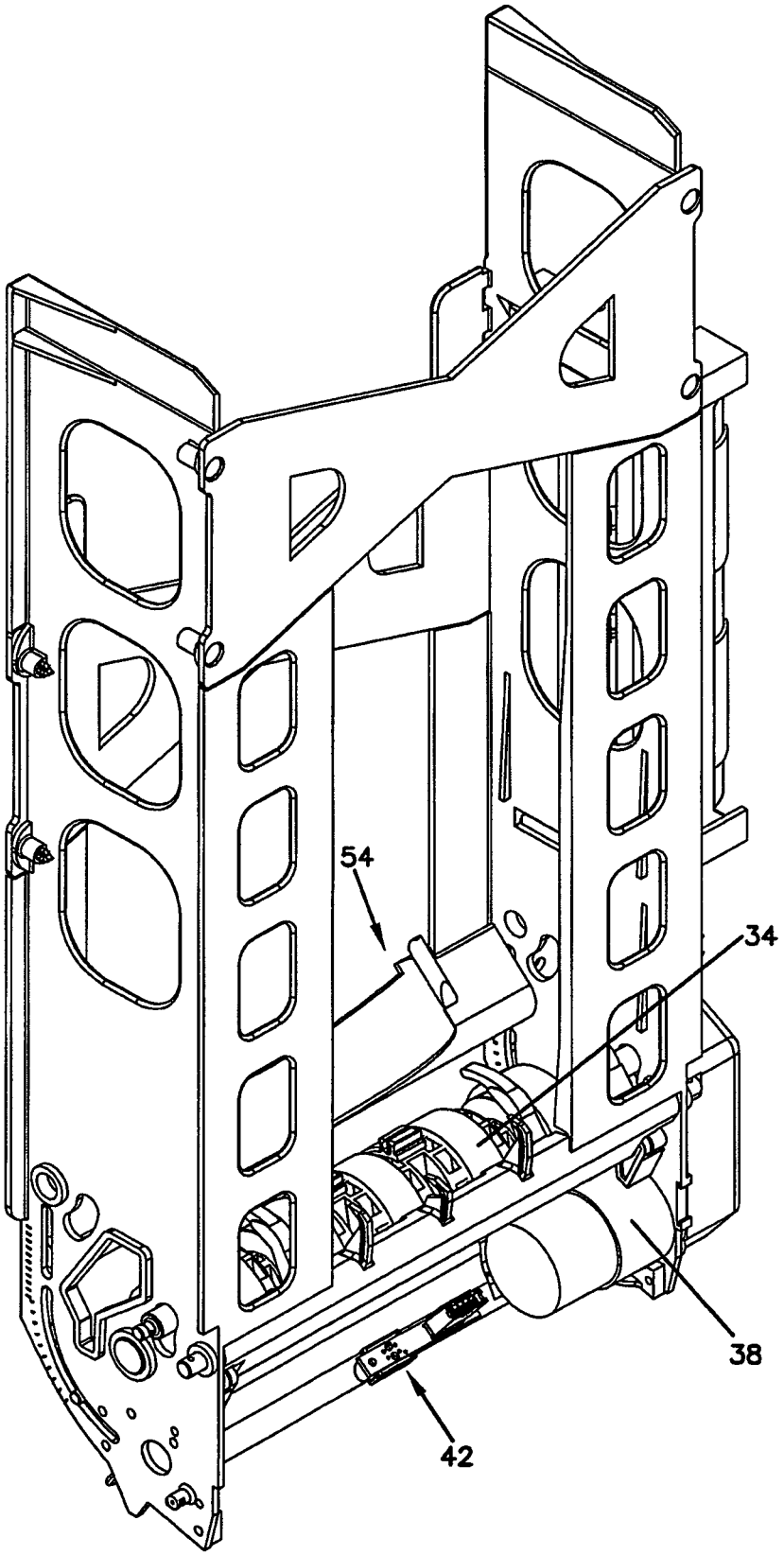
FIG. 5 is a rear perspective view of the paper towel dispenser of FIG. 1, shown without paper toweling.

Referring now to FIGS. 3 and 4, the drive mechanism 16 of the present paper towel dispenser generally includes a drive roller 34 and a pinch roller 36. The drive roller 34 is driven by a motor 38 (FIG. 5). In use, a leading portion 40 (e.g., the end portion or leading end) of the continuous length of paper toweling 12 is positioned between the drive roller 34 and the pinch roller 36 for subsequent dispense upon activation of the motor 38. Providing a dispenser that positions the leading portion of toweling between the rollers and within the interior of the housing aids in preventing contamination that can otherwise occur with conventional arrangements having exposed towel ends that extend outside the dispenser housing.

A sensor 42 (FIG. 4) is located so as to sense or detect an object at a location outside the dispenser housing 14. When an object, such as a hand, is placed within sensing proximity of the sensor 42, the dispenser 10 initiates dispensing operation by activating the motor 38. In the illustrated embodiment, the sensor 42 is directed to sense an object at a location beneath the dispenser and is angled in a direction toward the front of the dispenser. In alternative embodiments, the sensor can be positioned elsewhere within or on the dispenser so as to have a different object-sensing location.

For example, the object-sensing location may be in front of the dispenser and/or the sensor positioned with a horizontal orientation for sensing an object forward of the sensor.

During dispensing operation, the motor 38 (FIG. 5) drives or rotates the drive roller 34 in a counterclockwise or first direction (see arrow A in FIG. 4) to dispense a predetermined length of towel 50. Dispensing a predetermined length of towel aids in reducing the overconsumption of toweling as only the desired number of towel lengths is dispensed (as determined by the number of sensor activations). In contrast, some conventional arrangements allow a user to unintentionally grasp and pull an excess number of, for example, interleaved towels.

The predetermined length of towel 50 is dispensed through an opening 46 located at or near the bottom of the dispenser 10. A blade 48 having a sharp or serrated edge is located adjacent to and forward of the opening 46 of the dispenser 10. The blade 48 cuts or separates the dispensed length of towel from the remainder of the continuous length of paper toweling 12 when the user pulls the dispensed paper towel 50 against the blade 48. (See dashed line in FIG. 4 illustrating the towel 50 being pulled against the blade 48, and a separated discrete towel 52, for example). If additional paper towels are needed, the user can reactivate dispensing operation by again placing an object in sensing proximity to the sensor 42. Dispensing operation generally continues in this manner until the continuous length of paper toweling 12 is depleted.

Figure 6:
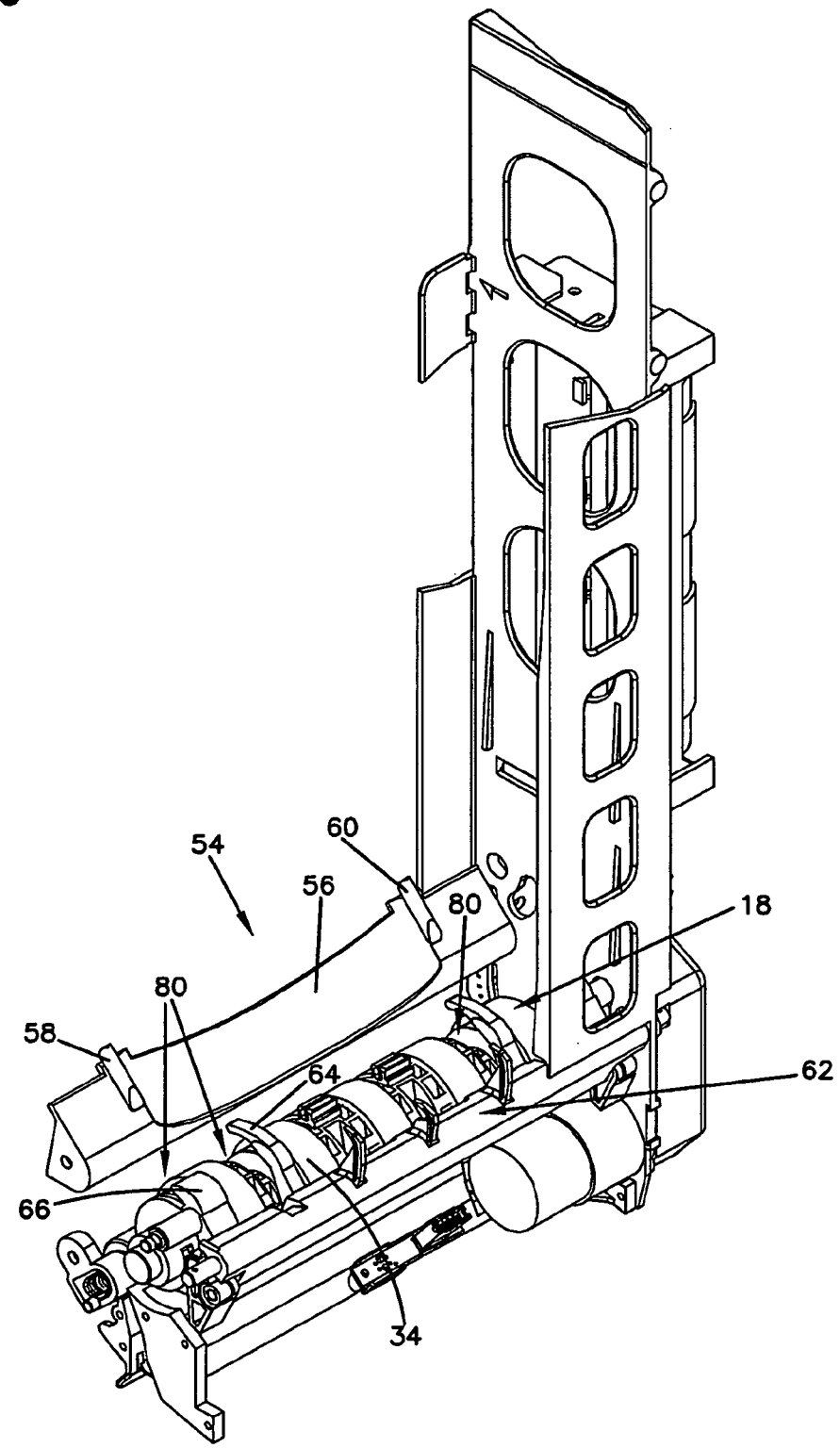
FIG. 6 is a partial perspective view of the paper towel dispenser of FIG. 5.

Referring now to FIGS. 5 and 6, the present dispenser is designed to minimize the frictional forces working against the dispense of the paper toweling. In particular, the dispenser includes a curved support element 54 having a concave inner surface 56 and cylindrical ribs 58, 60 located at opposite sides of the concave inner surface 56. As can be understood by reference to FIG. 1, the continuous length of paper toweling 12 is supported such that the curved support element 54 contacts the toweling 12 in essence only along edge portions of the toweling 12 (see gap G under toweling 12 in FIG. 1). This reduces the frictional forces on the toweling 12 in comparison to arrangements having a shelf that contacts a toweling supply along the entire width of the toweling supply. The curved support element 54 and ribs 58, 60 are further angled to promote downward placement of the paper toweling 12 within the interior of the dispenser housing 14; and to promote contact between the paper toweling 12 and the drive roller 34, as will be discussed hereinafter. In an alternative embodiment, the curved support element 54 can be configured to translate, oscillate, or otherwise move to shuffle or promote the downward placement of the paper toweling 12 within the interior of the dispenser housing 14, and promote contact between the paper toweling 12 and the drive roller 34.

Figure 7:
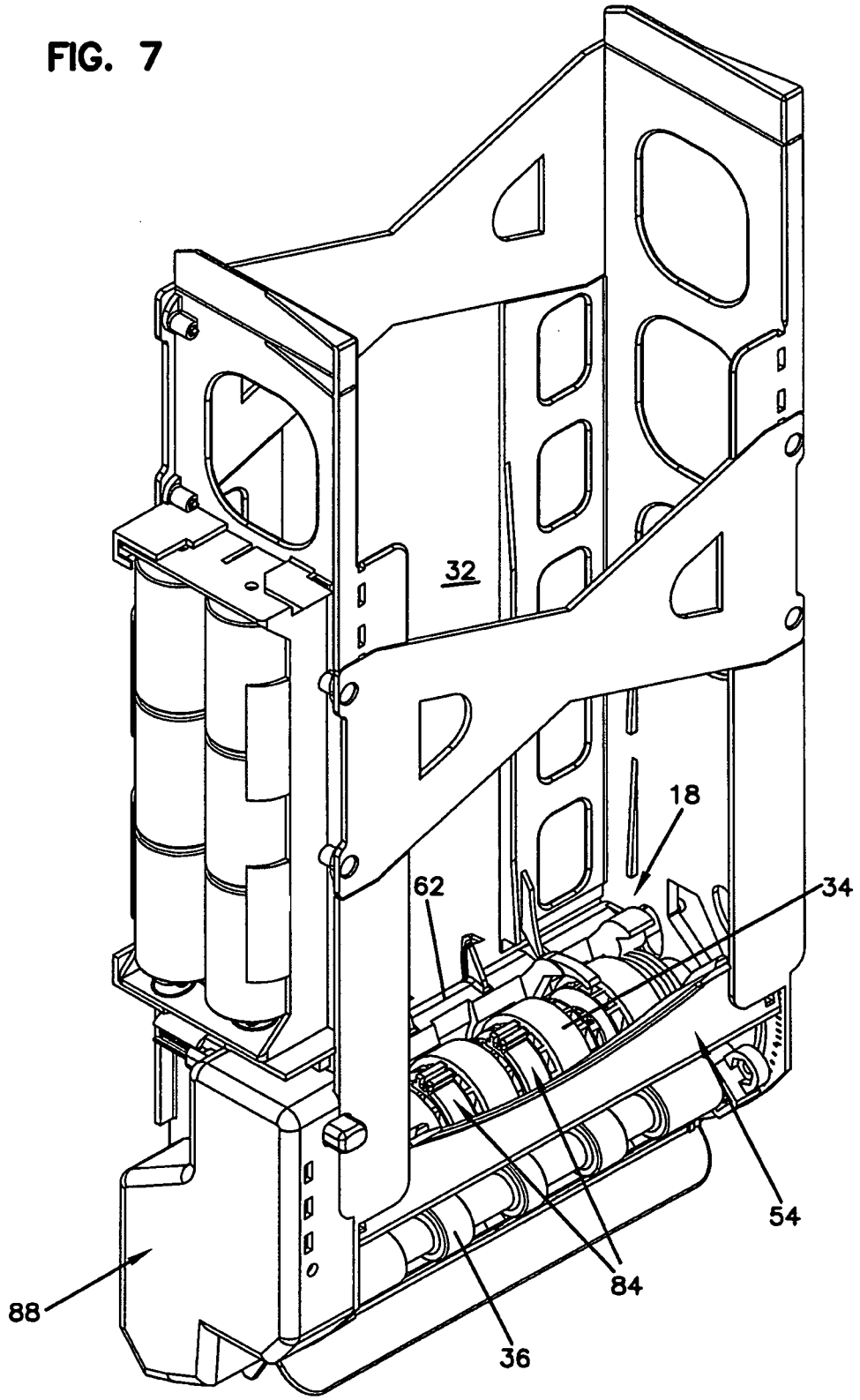
FIG. 7 is a front perspective view of the paper towel dispenser of FIG. 5.

As previously described, in some conventional arrangements, the depleted dispenser is replenished by loading paper toweling into the dispenser and manually feeding an end of the toweling between two rollers for subsequent dispense. Referring now to FIGS. 6 and 7, the automatic paper-loading arrangement 18 of the present disclosure automatically positions the paper toweling for dispense without having to manually position an end of the paper toweling at a particular loading location. A maintenance person instead need only place the replenishing unit of paper toweling within the paper supply region 32; the dispenser then automatically loads the paper toweling between the two rollers 34, 36 for dispense. Further, the present automatic paper-loading arrangement 18 permits a maintenance person to stock the dispenser with one or more replenishing units of paper toweling and automatically loads those replenishing units of toweling upon depletion of the prior unit of toweling. Unlike conventional arrangements, a maintenance person is not required to return to the dispenser each time a prior unit of toweling is depleted.

In short, each unit of toweling, whether stocked in multiples within the supply region or whether individually loaded into an empty supply region, is automatically loaded by the dispenser. What is meant by "automatically" is that the end of the toweling is positioned for subsequent dispense by components within the dispenser (i.e., by operation of the dispenser), as opposed to being manually position for subsequent dispense by a maintenance person or user.

Referring still to FIGS. 6 and 7, the automatic paper-loading arrangement 18 includes a towel support 62 that is positionable in both a first dispensing position and a second auto-loading position. The towel support 62 in cooperation with the curved support element 54 previously described support the bulk of the continuous length of paper toweling within the supply region 32 and above the drive and pinch rollers 34, 36.

The loading operation of the paper-loading arrangement 18, including the positioning of the towel support 62, is illustrated in FIGS. 9-17.

Figure 8:
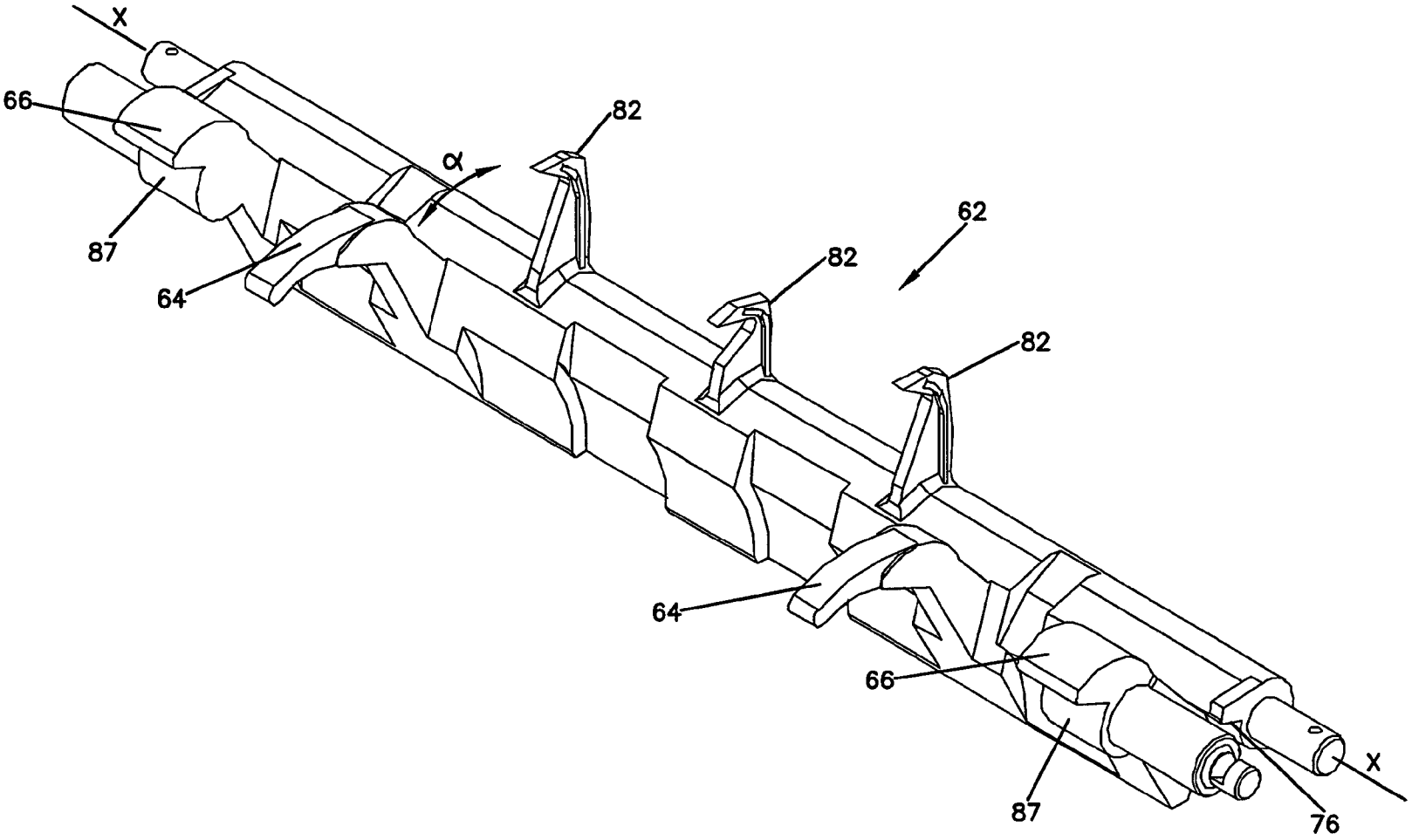
FIG. 8 is a perspective view of a towel support of the paper towel dispenser of FIG. 5, shown in isolation.
Figure 9:
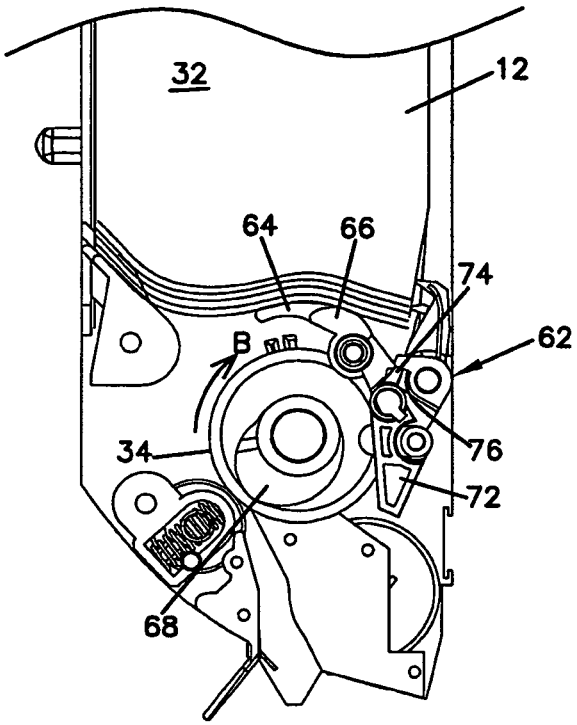
FIGS. 9-17 are partial side elevation views of the internal components of the dispenser of FIG. 1, illustrating steps during loading operation, including the positioning of the towel support and the direction of rotation of the drive roller.

The loading operation of the dispenser with reference to FIGS. 9-17 is described in the context of loading an empty dispenser. Referring to FIG. 9, a new unit of paper toweling 12 is placed within the paper supply region 32 of the dispenser. In FIG. 9, the towel support 62 is positioned in the first dispensing position. In the first dispensing position, the towel support 62 supports or holds the bulk of the paper toweling 12 generally above the rollers 34, 36. In particular, the paper toweling 12 is supported by one or more support arms 64, 66 (see also FIG. 8) spaced along the length of the towel support 62. In the illustrated embodiment, the central support arms 64 are elongated to prevent the paper from folding inward.

Figure 10:
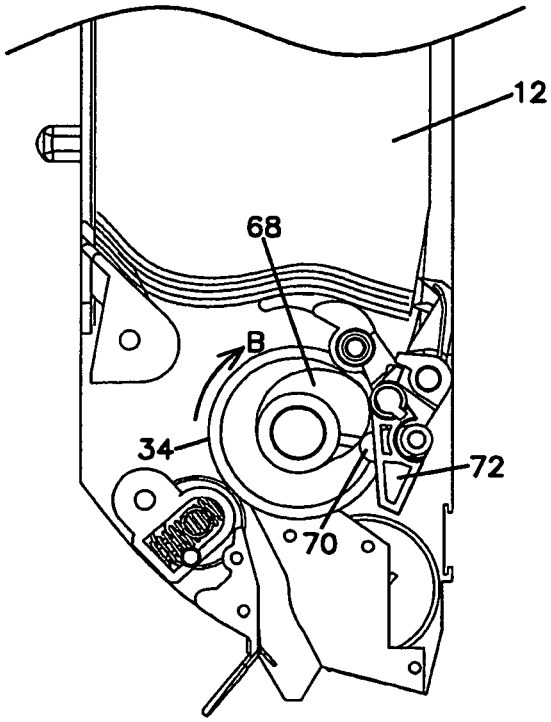
Figure 11:
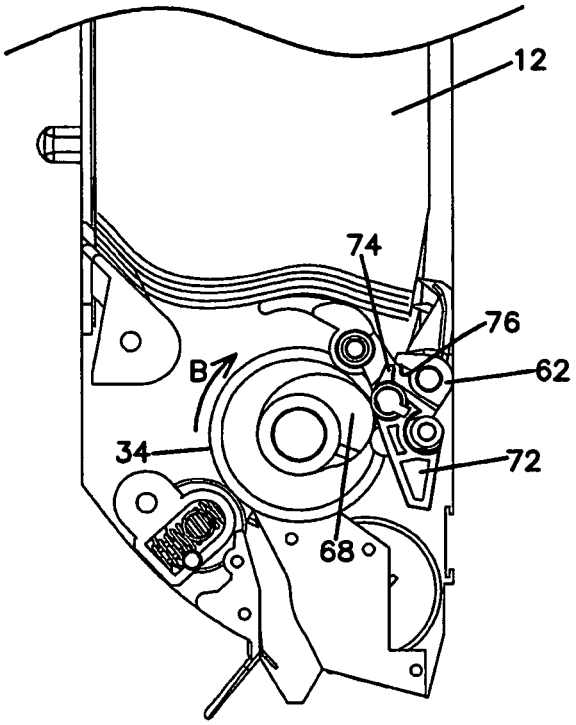

When loading operation is activated (e.g., by triggering the sensor 42), the drive roller 34 rotates in a clockwise or second direction (see arrow B in FIG. 9). The drive roller 34 includes a cam 68 that rotates with the drive roller 34. Referring now to FIG. 10, as the drive roller 34 rotates, the cam 68 contacts a rocker arm 70 that is attached to a pawl 72. Referring to FIG. 11, as the drive roller 34 and cam 68 continue rotating, an end 74 of the pawl 72 disengages from a notch 76 formed in the towel support 62. (See also FIG. 8 illustrating the notch 76 in the towel support 62.)

Figure 12:
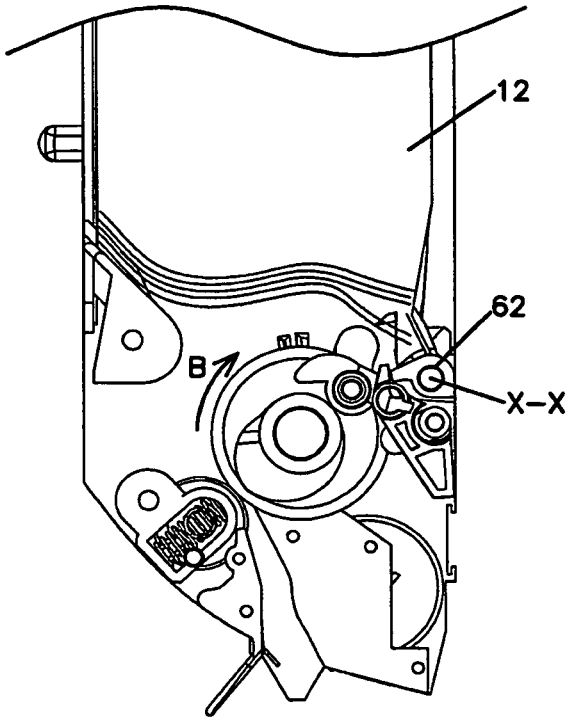

Referring to FIG. 12, when the end 74 of the pawl 72 disengages from the notch 76 of the towel support 62, the towel support 62 moves or pivots counterclockwise about axis X-X to the second auto-loading position. (See again FIG. 8 for the structure of the towel support 62 defining the pivot axis X-X.) The pivoting movement can be provided by way of gravity and the weight of the paper toweling 12 on the towel support 62, or can be aided by a spring 78, as shown in FIG. 2.

Figure 13:
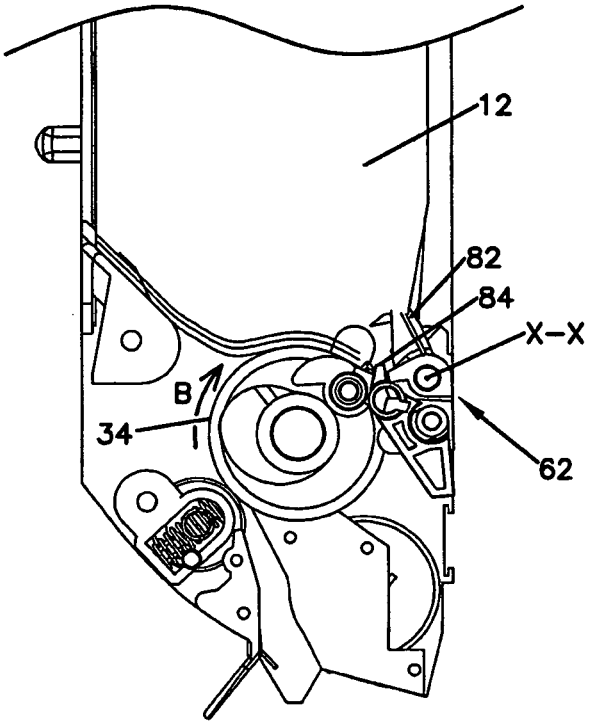

Referring to FIG. 13, the pivoting movement of the towel support 62 from the first position to the second position causes the paper toweling 12 to engage the drive roller 34. In particular, as the towel support 62 moves toward the second position, the support arms 64, 66 of the towel support become disposed within grooves 80 (see FIG. 6) of the drive roller 34; the toweling 12 supported by the arms 64, 66 thereby contacting the outer diameter of the drive roller 34. In one embodiment, fingers 82 are provided on the towel support 62 to urge the paper toweling 12 into engagement with the drive roller 34 as the towel support 62 pivots in the counterclockwise direction about axis X-X. Referring to FIG. 8, the fingers 82 are radially angled (a) relative to the support arms 64 so as to latch into and provide a downward force on the paper toweling 12 when in the second position. In an alternative embodiment, the towel support 62 can be provided without fingers and simply rely upon the weight of the toweling to encourage loading contact with the drive roller. In yet another alternative embodiment, the fingers can be a separate member that actuate by a spring arrangement, by gravity, or by a cam arrangement.

Figure 19:
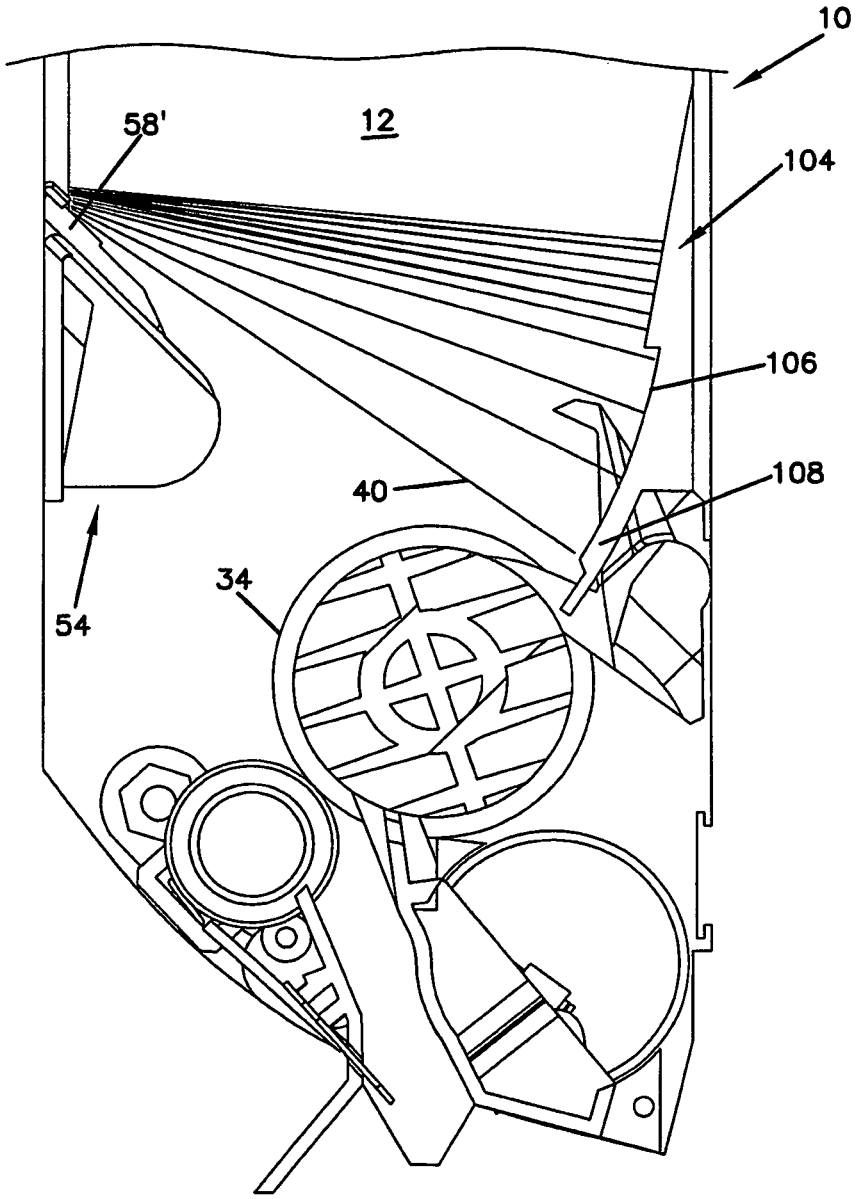
FIG. 19 is a partial side elevation view of the internal components of the dispenser of FIG. 1, illustrating the dispenser with a positioning element and undercut features of a support element.

Referring now to FIG. 13, the drive roller 34 continues to rotate in the clockwise direction (see arrow B) until a rake or paper grasp 84 is located behind or rearward of the leading portion 40 of the paper toweling 12. This rotation also aids in positioning the leading edge of the leading portion 40 of the toweling 12 toward the rear of the dispenser housing in a location preferable for loading. The degree of rotation until this time is determined by the diameter of the drive roller 34. (See FIGS. 2 and 7 for addition views of the paper grasp 84.) Referring to FIG. 19 and in one embodiment, the dispenser 10 includes a positioning element 104. The positioning element 104 has fanning structures, such as an offset surface or offset rib 106, that fans out the paper toweling 12 and thereby reduces frictional loading forces from the stacked trailing end of the continuous length of paper toweling. The positioning element 104 also has a positioning rib 108 that assists in positioning the leading paper portion 40 in the proper position for loading. As previously described, the curved support element 54 is angled (see also FIG. 6); the angled support element 54 promotes the rear folded edges of the paper toweling 12 into contact with the positioning element 104.

Referring again to FIG. 13, once the paper grasp 84 is positioned rearward of the leading portion 40, the direction of rotation of the drive roller 34 is reversed. Proper positioning of the paper grasp 84 rearward of the leading portion of toweling can be determined by the angular positioning of the cam 68, the paper grasp 84, and/or the drive roller 34.

Figure 14:
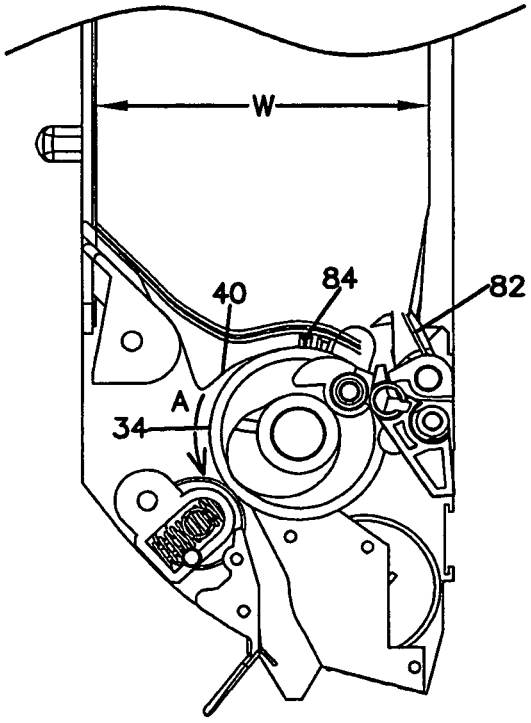
Figure 15:
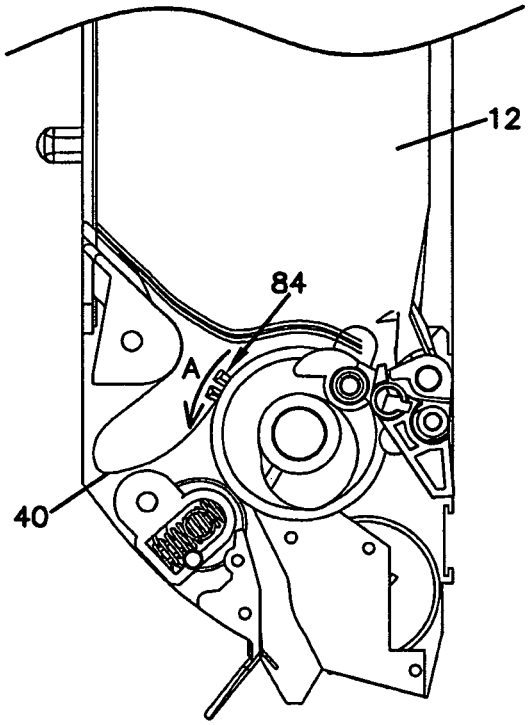

Referring now to FIG. 14, after the paper grasp is positioned rearward of the leading portion 40 of toweling, the drive roller 34 rotates in the first counterclockwise direction so that the paper grasp 84 engages the leading edge or leading portion 40 of the paper toweling 12. Continued counterclockwise rotation (see arrow A in FIGS. 15 and 16) carries the leading portion 40 through a nip point 86 between the drive roller 34 and the pinch roller 36 at which point the leading portion 40 is released by the paper grasp 84. (The release is a function of the carrying or grasping force of the paper grasp 84 being less than the pinch forces at the nip point 86 between the rollers 34, 36.) The distance defined by the rotation of the drive roller 34 from the point at which the leading portion 40 of paper is grasped to the nip point 86 is less than the width (W) of the paper toweling 12 so that the leading portion 40 of the paper toweling is pinched between the rollers 34, 36 before the paper grasp 84 completes a full rotation and contacts a trailing folded edge the paper toweling 12. It is noted that in the illustrated embodiment, the paper grasp 84 is provided on the drive roller 34 and rotates with the drive roller 34 during dispense. Grooves 81 (FIG. 3) are provided in the pinch roller 36 to permit the paper grasp 84 to pass thereby.

As an alternative, the paper grasp 84 can be of various shapes, heights, and quantities positioned around the drive roller 34. In yet another alternative, a paper grasp can be omitted with the loading operation relying only on frictional forces between the leading portion 40 and the drive roller 34. In still another alternative, the paper grasp can be actuated radially so as to only contact the toweling during loading operation and be contracted radially during dispensing operation. Such radial activation and contraction can be achieved by a cam or other mechanism.

Figure 16:
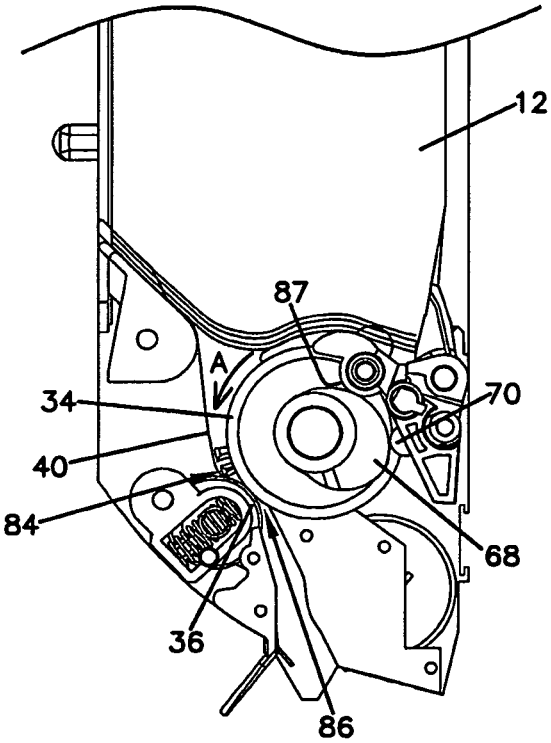

Referring to FIG. 16 and continuing the loading operation, the leading portion 40 of the paper toweling 12 is now located between the rollers 34, 36 at the nip point 86. The drive roller 34 continues rotation in the first counterclockwise direction until the cam 68 contacts the rocker arm 70. The cam 68 is sized and shaped to also contact a curved surface 87 formed on the towel support 62. (See also FIG. 8 illustrating the curved surface 87.)

Figure 17:
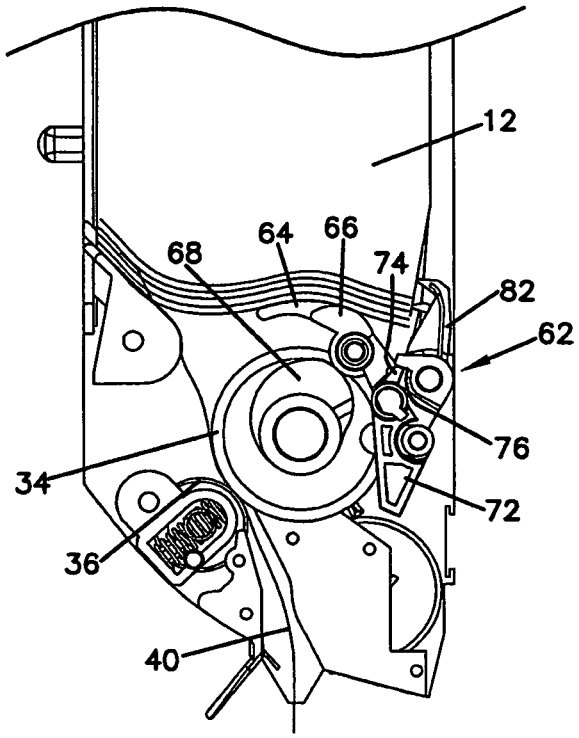

Contact between the cam 68 rotating in the counterclockwise direction and the curved surface 87 causes the towel support 62 to lift upward and return or pivot back to the first dispensing position, as shown in FIG. 17. The fingers 82 of the towel support 62 likewise return to the position shown in FIG. 17 such that the fingers no longer apply a downward force on the paper toweling 12. In this first position, the support arms 64, 66 again support the bulk of the toweling 12 above the rollers 34, 36.

Referring again to FIGS. 16 and 17, contact between the cam 68 rotating in the counterclockwise direction and the rocker arm 70 also causes the end 74 of the pawl 72 to be repositioned within the notch 76 of the towel support 62 to lock or hold the towel support 62 in the first dispensing position of FIG. 17. In one embodiment, the pawl 72 rotates back into position so as to engage the notch 76 by movement of the cam 68 and gravity; in another embodiment, a spring (not shown) can aid in the pawl's rotation.

The end 74 of the pawl 76 engages the notch 76 of the towel support 62 near a maximum offset of the cam 68 such that during counterclockwise rotation of the drive roller 34 there is some limited movement of the towel support 62. This movement aids in the positioning of the paper toweling 12 in preparation for the next autoload (e.g., the movement aids in shuffling the toweling downward toward the paper-loading arrangement). In an alternative, the end 74 of the pawl 76 can engage the notch at an absolute maximum cam offset such that no movement of the towel support 62 occurs.

The dispenser 10 in FIG. 17 is now loaded for dispensing operation. As can be understood, the same loading sequence or loading operation occurs when one unit of toweling is depleted and a second unit of toweling stored within the supply region 32 is available for loading. The present dispenser thereby allows for storage or stocking of multiple units of continuous paper toweling within the supply region 32 of the dispenser, each unit self-loading or being automatically loaded upon depletion of a prior leading unit.

Figure 20:
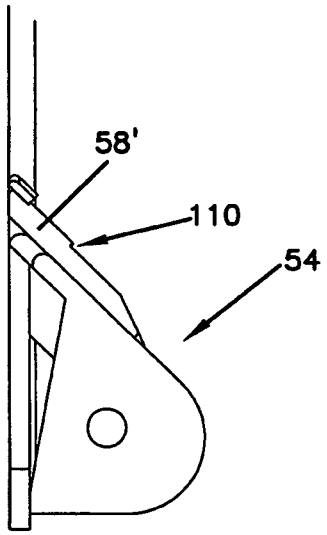
FIG. 20 is a side elevation view of the support element of FIG. 19, shown in isolation.

Referring to FIGS. 19 and 20, in one embodiment the dispenser can include a support element 54 that has an undercut structure 110 formed in the ribs (e.g., 58') of the support element. The undercut feature 110 prevents a partially depleted stack of paper toweling from being improperly positioned within the dispenser. That is, the undercut structure 110 functions as a stop to prevent a smaller stack of toweling from being pushed forward by rotation of the drive roller 34 toward the front of the dispenser housing.

Figure 21:
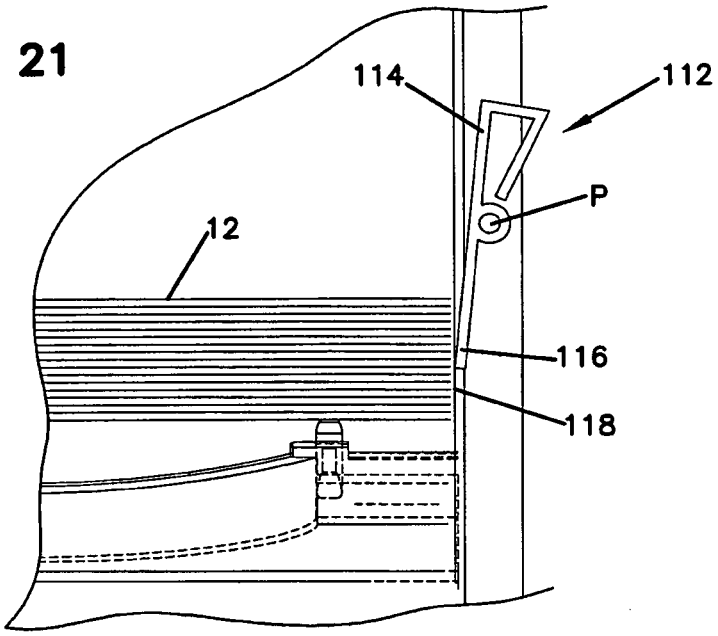
FIG. 21 is a partial front elevation view of the dispenser of FIG. 1, illustrating the dispenser with a pivoting arm, the pivoting arm being oriented in a first position.
Figure 22:
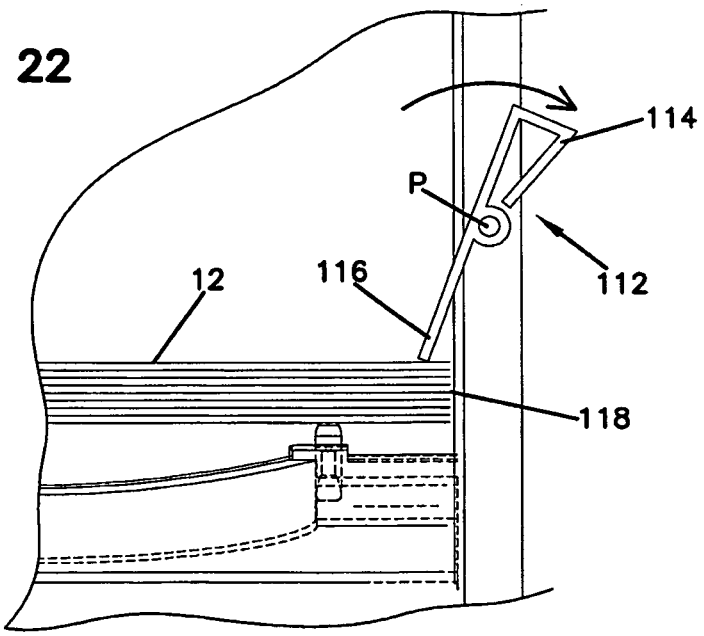
FIG. 22 is a partial front elevation view of the dispenser of FIG. 21 illustrating the pivoting arm oriented in a second position.

Referring to FIGS. 21 and 22, in yet another embodiment the dispenser can include a pivoting arm 112 that holds the paper in place as the paper depletes during dispensing operation. The pivoting arm 112 has a first end 114 and a second end 116 with a pivot point P therebetween. The first end 114 is weighted and positioned overcenter with respect to the pivot point P so as to naturally pivot to the position shown in FIG. 22. When a fuller stack of paper toweling 12 is located within the dispenser housing, the height and weight of the fuller stack causes the arm 112 to be positioned as shown in FIG. 21. Once the stack depletes to a size such that the second end 116 of the arm 112 is able to pass by the side edges 118 of the paper toweling, the arm 112 pivots and becomes positioned as shown in FIG. 22. In this pivoted position of FIG. 22, the second end 116 of the arm 112 holds the paper toweling 12 in place during further depletion.

It is noted that the previous description describes the components of the automatic paper-loading arrangement with reference to only a single set of components (e.g., located on one side of the dispenser). As can be understood, similar components (e.g., a second cam, a second rocker arm, a second pawl, and a second pivoting arm) can be provided on the other side the dispenser as well.

Figure 18:
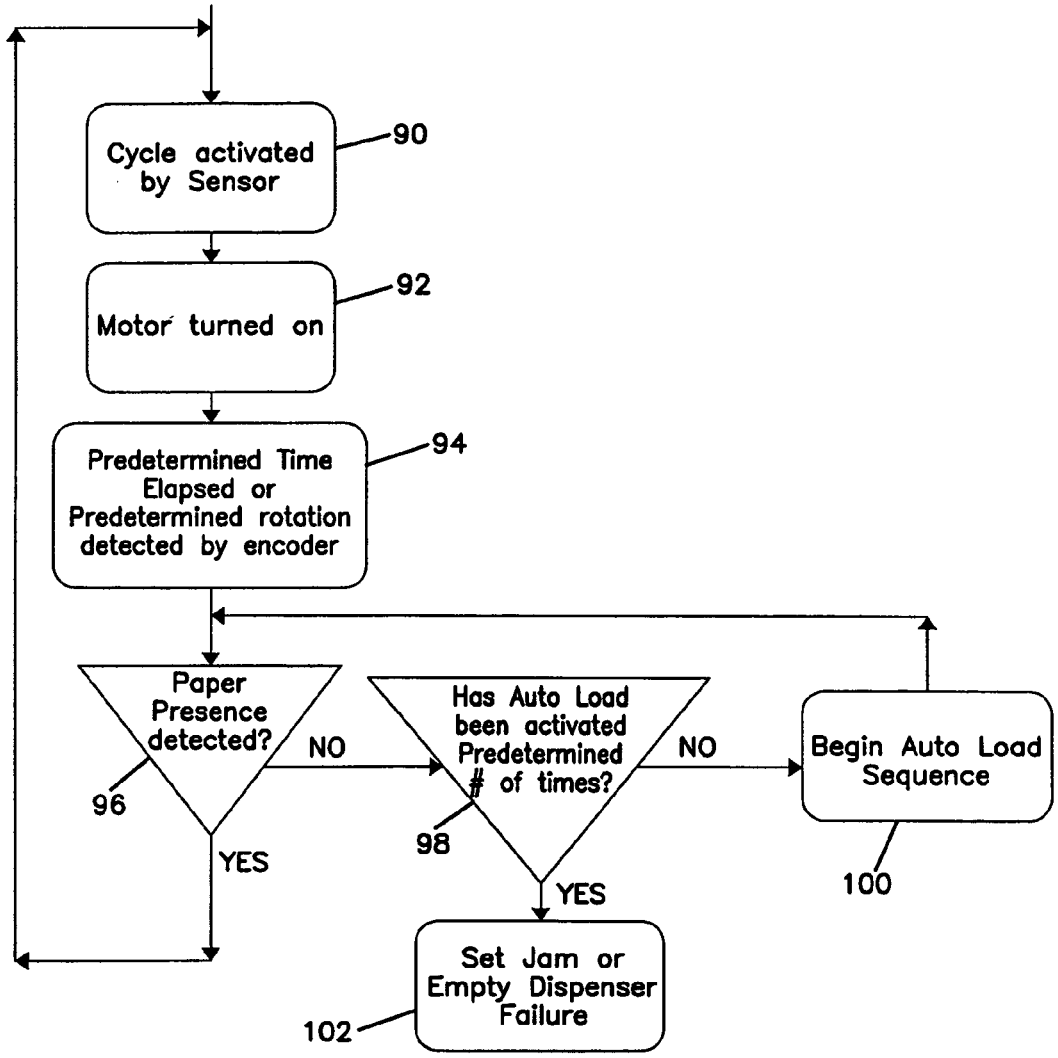
FIG. 18 is a diagrammatic representation of the operation of the paper towel dispenser of FIG. 1.

Referring now to FIG. 18, a schematic representation of the operation of the dispenser is provided. Operation is controlled by a processor or programmable logic controller (generally shown at 88 in FIG. 7). In a first step 90 of the operation sequence, the processor receives a request for a paper towel (e.g., the sensor is activated). The processor then initiates dispensing operation by activating the motor 38 (step 92). The motor 38 drives the drive roller 34 for a predetermined time period or drives the drive roller a predetermined degree of rotation or number of revolutions (step 94). If paper is loaded and properly dispensed to the user, the leading portion 40 of the toweling is detected by the sensor 42 (step 96). The dispensed leading portion of the toweling is now located for removal and use by the user, and the operation sequence returns to the first step 90 to await another towel request via activation of the sensor.

If at step 96, the leading portion of the toweling is not detected, loading operation is initiated (step 100). Loading operation occurs as previously described and with respect to FIGS. 9-17. If paper is properly loaded and dispensed to the user via the loading operation step 100, the leading portion 40 of the toweling is detected by the sensor 42 (step 96). The dispensed leading portion of the toweling is now located for removal and use by the user, and once again the operation sequence returns to the first step 90 to await another towel request via activation of the sensor.

If after loading operation (step 100) the sensor fails to detect the presence of the leading portion of toweling at step 96, the processor again initiates loading operation (step 100). The processor allows the dispenser to continue loading attempts for a predetermined number of times. When the number of attempts to load paper toweling exceeds the predetermined number of times (counted at step 98), an alarm or signal is generated (step 102) which indicates that either the dispenser is empty or that a paper jam has occurred inside the dispenser requiring maintenance.

Referring back to step 90, activation is described as a request for paper towel by a user (i.e., by placing an object in sensing proximity to the sensor to trigger or activate the sensor). In an alternative embodiment, closure of the removable cover 22 or placement of the removable cover 22 on the frame 20 can activate operation as well.

In the present dispenser and with reference to the operation depicted in FIG. 18, the single sensor 42 in the dispenser 10 has two primary operational functions: one to initiate dispensing operation, and the other to initiate loading operation. In particular, the sensor 42 initiates dispensing operation when the sensor senses a user's request for paper towel. The sensor also senses when a leading portion of the length of toweling is located at a predetermined position within the dispenser housing; absence of the leading portion at the predetermined position activates the dispenser's loading operation. In the present embodiment and with regard to dispensing operation, the sensor also detects the presence of a dispensed towel that has not been removed and prevents further towel dispensing until that towel is removed. In the alternative, the length of dispensed paper towel can cover the sensor and prevent further activation of a dispensing operation.

In an alternative dispenser embodiment, more than one sensor can be utilized for the initiation of dispensing operation and loading operation. For example, a first sensor can detect a user's hand to initiate dispense and a second sensor can initiate loading operation. In another alternative, a first sensor can be utilized for initiation of dispensing operation and a second sensor can be utilized to detect the paper presence of a dispensed towel. In yet a further alternative sensor arrangement, two separate infra-red emitters and one sensor can be used to initiate operation and detect the presence of a dispensed towel. In still a further alternative sensor arrangement, one sensor and one infra-red emitter can be separated by a predefined distance and angle that permit detection of a dispensed towel and detection of a user's hand within a predefined area.

In addition to initiating dispensing operation and loading operation through use of the sensor 42, the programmable logic controller also can provide a delay between cycles of dispense to control towel consumption. The controller can operate the motor 38 so as to position the leading portion of the toweling such that the leading edge is not exposed prior to receiving a towel request. The controller also may be used to detect when the cover 22 is closed or properly placed on the frame 20 of the housing, preventing dispensing and/or loading operation when the cover is open or removed from the frame. Because the controller is programmable, the length of towel dispensed can be controlled or adjusted by adjusting the time period, or degree of rotation or number of revolutions corresponding to the motor activation. In one embodiment, the controller also allows adjustment of the sensitivity of the sensor so as to avoid inadvertent towel dispense. Failure signals, such as a light or audible signal in the event of low paper, no paper, a jam, or low battery or low power, can also be controlled by the controller. The controller can further be used to store and retrieve data by way of a data port or by sequencing an emitter.

The disclosed loading feature of the present dispenser eases maintenance by automatically loading the continuous length of toweling for dispense upon positioning the towel support in the disclosed positions corresponding to the direction of rotation of the drive roller. Such positioning includes positioning the towel support in the first dispensing position when the drive roller rotates in the first direction, and positioning the towel support in the second auto-loading position when the drive roller rotates in the second direction. Rotation of the drive roller from the second direction to the first direction then automatically positions the toweling for dispense.

In addition and because of the disclosed loading feature, more than one unit of paper toweling can be stored within the dispenser, thereby reducing the number of maintenance visits required to maintain dispensing operation and improving the reliability of use for the user.

The above specification provides a complete description of the present invention. Since many embodiments of the invention can be made without departing from the spirit and scope of the invention, certain aspects of the invention reside in the claims hereinafter appended.

What is claimed is:

1. A method of loading a paper towel dispenser, the dispenser having a drive roller that rotates in a first direction to dispense paper towel, the method comprising the steps of:

a) detecting the absence of a leading portion of a continuous length of paper toweling at a predetermined position;

b) automatically loading a leading portion of the continuous length of paper toweling for subsequent dispense, wherein the continuous length of paper toweling comprises a pleated stack of paper toweling, including:

i) rotating the drive roller in a second direction to allow a towel support to move from a first position to a second position and move support arms of the towel support into grooves of the drive roller to put toweling into contact with the drive roller;

ii) rotating the drive roller in the first direction to position the leading portion at the predetermined position and to move the towel support from the second position to the first position.

2. A towel dispenser, comprising:

a) a dispenser housing;

b) a drive roller including a cam and grooves;

c) a pivoting towel support positionable in a first dispensing position and a second auto-loading position, the towel support having support arms for supporting toweling, when toweling is in the dispenser; and d) a pawl that contacts the cam during rotation of the drive roller, wherein the pawl holds the towel support in the first dispensing position when the drive roller rotates in a first direction and releases the towel support so that the towel support pivots to the second auto-loading position when the drive roller rotates in the second direction and causing the support arms of the towel support to be disposed in the grooves of the drive roller, whereby the toweling contacts the drive roller when toweling is in the dispenser.

3. The towel dispenser of claim 2, further including a sensor that senses one of the presence and absence of paper towel inside the dispenser housing.

4. The towel dispenser of claim 3, wherein the sensor also senses an object at a location outside the dispenser housing.

5. The towel dispenser of claim 2, further including a continuous length of pleated paper toweling.

6. A towel dispenser, comprising:

a) a dispenser housing;

b) a drive roller that dispenses a length of paper towel from a continuous length of toweling;

(i) the drive roller being rotatable in first and second opposite directions;

(ii) the drive roller having a cam and grooves;

c) a towel support that pivots between a first position and a second position;

(i) the towel support being provided in the first position when the drive roller rotates in the first direction, (ii) the towel support being provided in the second position when the drive roller rotates in the opposite second direction;

(iii) the towel support having a notch and support arms; the support arms for supporting the toweling, when toweling is in the dispenser;

d) a pawl having a pawl portion that releasably engages the notch in the towel support;

(i) when the drive roller rotates in the first direction, the pawl portion is engaged with the notch to hold the towel support in the first position;

(ii) when the drive roller rotates in the second direction, the cam on the drive roller engages the pawl to release the pawl portion from the notch to allow the towel support to move into the second position;

(A) the second position of the towel support including the support arms of the towel support being disposed in the grooves of the drive roller, whereby the toweling contacts the drive roller when toweling is in the dispenser and automatically loads a continuous length of toweling for dispense.

7. The towel dispenser of claim 6, wherein the drive roller rotates in the first direction to dispense the length of paper towel from the dispenser housing.

8. The towel dispenser of claim 7, further including a sensor that senses when a leading portion of the length of the paper towel is located at a predetermined position within the dispenser housing.

9. The towel dispenser of claim 8, wherein upon the absence of the leading portion of the length of paper towel at the predetermined position, the drive roller rotates in the second direction.

10. The towel dispenser of claim 8, wherein the sensor also senses a user's request for dispense of the length of paper towel.

11. The towel dispenser of claim 6, further including a continuous length of toweling.

12. The towel dispenser of claim 11, wherein the continuous length of toweling is a pleated stack of paper toweling.

13. The towel dispenser of claim 6, further including a curved support element having a concave surface supporting the continuous length of toweling during dispense.

14. The towel dispenser of claim 6, further including fingers provided on the towel support, the fingers engaging the continuous length of toweling to urge contact between the toweling and the drive roller when the towel support is in the second position.

15. The towel dispenser of claim 6, further including a rake that engages a leading portion of the continuous length of toweling, the rake positioning the leading portion at a predetermined location for subsequent dispense.

16. The towel dispenser of claim 6, further including a processor that activates a loading operation upon the absence of the leading portion of the continuous length of toweling at a predetermined location, wherein the processor is constructed to activate the loading operation.

* * * * *